United States Patent [19]

Horn

[11] Patent Number: 5,074,757

[45] Date of Patent: Dec. 24, 1991

[54] DIAPHRAGM PUMP WITH MECHANICALLY DRIVEN DIAPHRAGM

[75] Inventor: Waldemar Horn, Leinfelden-Echterdingen, Fed. Rep. of Germany

[73] Assignee: LEWA Herbert Ott GmbH & Co., Fed. Rep. of Germany

[21] Appl. No.: 583,504

[22] Filed: Sep. 17, 1990

[30] Foreign Application Priority Data

Sep. 21, 1989 [DE] Fed. Rep. of Germany ..... 3931516

[51] Int. Cl.[5] ..... F04B 21/00

[52] U.S. Cl. ..... 417/63; 417/413; 417/395; 92/100; 92/103 SD

[58] Field of Search ..... 417/63, 413, 395; 92/100, 103 R, 103 SD, 104

[56] References Cited

U.S. PATENT DOCUMENTS

| | | | |
|---|---|---|---|
| 3,131,638 | 7/1962 | Wilson et al. | 92/97 |
| 3,982,559 | 9/1976 | Ochs | 92/97 |
| 4,334,838 | 6/1982 | Fessler et al. | 417/395 |
| 4,741,252 | 5/1988 | Harter et al. | 92/99 |

*Primary Examiner*—Richard A. Bertsch
*Assistant Examiner*—Charles Freay
*Attorney, Agent, or Firm*—Bierman & Muserlian

[57] ABSTRACT

In a diaphragm pump with mechanically driven diaphragm and a device for diaphragm rutpure signaling, wherein the diaphragm 2 is clamped at the edge between a pump body 3 and pump cover 4 and is centrally firmly connected with a support plate 5 serving to drive the diaphragm. the design is such that the diaphragm is formed as a multi-layer sandwich diaphragm 2, whose individual layers or diaphragm plies are clamped jointly in the edge region between pump body 3 and pump cover 4. The sandwich diaphragm 2 consists of a working diaphragm 18 with at least one diaphragm ply and a protective diaphragm 20 also with at least one diaphragm ply. The latter is formed so that, with the working diaphragm 18 intact, it is clearly stressed by the delivery pressure less than the working diaphragm 18. Lastly the device for diaphragm rupture signaling has at least one channel 22, 25 disposed between the diaphragms 18, 20 and brought to the outside, for signaling a rupture of the working diaphragm 18.

11 Claims, 5 Drawing Sheets

DIAPHRAGM PUMP WITH MECHANICALLY DRIVEN DIAPHRAGM

Figure 1:
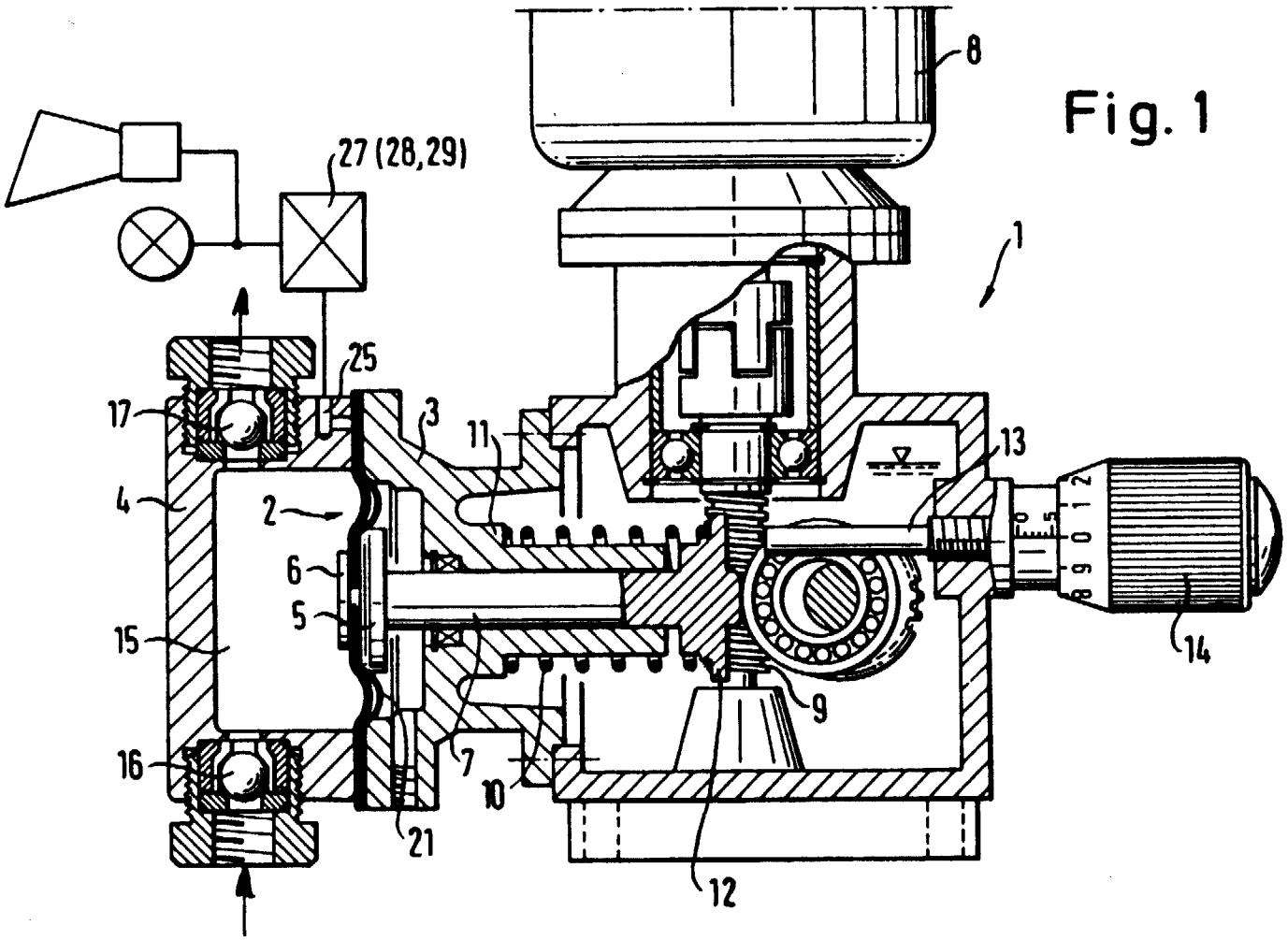

The invention relates to a diaphragm pump with mechanically driven diaphragm and with a device for diaphragm rupture signaling.

Diaphragm pumps of the type in question, having a mechanical diaphragm linkage, are widely used because of their simple and cost-effective design and because of their leakproofness.

Since, however, the diaphragm in such a diaphragm pump is under high load, not only is its life limited, but also there is danger after a certain service time that a diaphragm rupture will occur, which for understandable reasons and to avoid greater subsequent damage should be detected as quickly as possible. Not only is it desirable, therefore, to provide in such diaphragm pumps a mechanically driven diaphragm of long life, but also there are, in case of a diaphragm rupture, the following additional requirements:

It must be assured that the diaphragm pump is sealed to the outside, i.e. no conveyed liquid must issue;

no subsequent damage, as e.g. corrosion at the drive mechanism, must occur on the diaphragm pump;

it must be possible to signal the diaphragm rupture immediately;

it must be possible to continue operating the diaphragm pump for a limited time, the delivered quantity changing only slightly or not at all after the diaphragm rupture, and handling, i.e. changing the diaphragm, should be quick and easy.

In this connection, at present two models of diaphragm pumps are known which include a device for diaphragm rupture signaling.

Thus, in a known double diaphragm pump (GB 305235) two mutually spaced diaphragms are provided, the first diaphragm being clamped separately in the pump housing and driven mechanically. The second diaphragm, spaced therefrom, is also clamped separately in the pump housing and is driven purely hydraulically by a fluid provided between the two diaphragms. Any diaphragm rupture is detected through a probe in the diaphragm interstice, e.g. by means of a conductivity measurement.

Such a design, however, has numerous disadvantages, which consist essentially, inter alia, in that after a diaphragm rupture the pump cannot continue to be operated, since as a rule it is always the first, mechanically driven diaphragm that breaks. In addition, as experience has shown, it is difficult to fill the interstice between the two diaphragms with the coupling fluid, which must be done with great care. Another factor is that gas formation in the fluid may cause reduced output of the diaphragm pump. Apart from the fact hat the known double diaphragm pump is structurally complicated and costly, mixing of the fluid filling with the conveyed liquid in case of a diaphragm rupture may present problems, and this may be especially disadvantageous for example in the food technology.

Another known diaphragm pump (DE-OS 21 46 016), which comprises a mechanically driven diaphragm and a device for diaphragm rupture signaling, has behind the actual delivering diaphragm a so-called safety diaphragm, which is clamped separately from the delivering diaphragm and normally runs along at no-load. In case of diaphragm rupture, this safety diaphragm serves as seal toward the drive mechanism, in order thereby to provide corrosion protection. A bore leading to the outside between the two diaphragms serves for diaphragm rupture signaling.

With such a design the disadvantage again is that after a diaphragm rupture the diaphragm pump cannot continue to be operated. Since furthermore two separate diaphragm clampings are provided, and are necessary, the entire construction is complicated and costly to manufacture. In addition it is necessary to design the diaphragm interstice so that it is resistant to the delivered liquid, and this too leads to increased cost of construction.

It is, therefore, the object of the invention to design the diaphragm pump of the type in question so that, to eliminate the described disadvantages, it is not only of simple design, cost effective and reliable, but also fulfills all of the initially mentioned requirements to be demanded of such a diaphragm pump.

The features of the invention conceived for the solution of this problem are evident from claim 1. Advantageous developments thereof are described in the additional claims.

As distinguished from the prior art, in the diaphragm pump of the invention the diaphragm is formed as a multi-layer sandwich diaphragm, the individual layers or plies of which are clamped in the edge region, not separately, but jointly, between the pump body and pump cover. This sandwich diaphragm consists on the one hand of a working diaphragm with at least one diaphragm ply acting on the delivered medium and, on the other hand, of a protective diaphragm also with at least one diaphragm ply. The protective diaphragm is designed so that, with the working diaphragm intact, it is clearly stressed less by, the delivery pressure than the working diaphragm. According to the invention, this can be achieved for example by designing the protective diaphragm so that in the flexible diaphragm deformation zone the working diaphragm does not brace against the protective diaphragm. A possible form of realization in this connection consists in that in the flexible diaphragm deformation zone the protective diaphragm is spaced from the working diaphragm.

A preferred embodiment of the invention consists in that the protective diaphragm has an annular bead, the concave side of which points to the delivery chamber. Further advantages result when all of the diaphragm plies of the sandwich diaphragm have an annular bead, the concave side of which points to the delivery chamber, the bead of the protective diaphragm being developed more than that of the working diaphragm.

The lesser stress on the protective diaphragm can, according to the invention, be achieved also by structurally different means, for example in that the protective diaphragm is made of a material of greater elasticity than the working diaphragm, or is designed in the region of the flexible diaphragm deformation zone as a corrugated diaphragm, which then has greater elasticity than the working diaphragm.

According to the invention it is further provided that the device for diaphragm rupture signaling contains at least one channel disposed between the diaphragms and leading to the outside, for signaling a rupture of the working diaphragm. This channel is arranged preferably in an intermediate ply between the working diaphragm and protection diaphragm and may have for example the form of one or more radial slots. Alternatively there may be provided between the working diaphragm and protective diaphragm, in the outer clamping region, a ring which contains the channel serving for the diaphragm rupture signaling.

All in all, a diaphragm pump which fulfills all of the initially mentioned requirements is thus created by the invention. The diaphragm designed according to the invention is composed, as has been set forth, as a multi-layer composite part, the individual diaphragm plies being made preferably of plastic, in particular polytetrafluoroethylene (PTFE) or a similar fluoroplastic. This diaphragm packet forms an integral unit with the central screw union at the support plate, so that handling is very simple if it becomes necessary to change the diaphragm.

Because the new diaphragm is formed as a sandwich diaphragm with working diaphragm and protective diaphragm and preferably an intermediate ply therebetween, this diaphragm may be regarded also as a three-zone diaphragm, the individual zones of which have different functions.

Thus, the first zone, which is formed by the working diaphragm toward the delivered medium, consists in the manner set forth before of at least one, preferably two or more diaphragm plies, in particular of plastic, and they perform the conveying. This means that the oscillating motion of the push rod mechanically driving the diaphragm is transformed into a volume displacement. In the region of its flexible diaphragm deformation zone, i.e. at the point between inner and outer clamping, the working diaphragm is preferably provided with a bead, which reduces the stress in the working diaphragm and at the same time produces a certain rigidity. Thereby the proportioning work remains largely independent of the delivery pressure.

Such a multi-layer working diaphragm design according to the invention offers the essential advantage that the pressure force is distributed over the individual diaphragm plies, so that the stresses in the discrete plies are reduced. This has an extremely favorable effect on the life of the diaphragm.

Another advantage is that the working diaphragm becomes completely nonfunctional only when all individual layers of the working diaphragm are damaged. Thus there must be a damage, for instance a tear, in each layer of the working diaphragm independently to result ultimately in the nonfunctionality of the working diaphragm. The advantageous consequence of this is that the failure rate is clearly lower.

Lastly the multi-layer design of the working diaphragm leads to the advantage that also the overall life is considerably lengthened. The reason for this is that, as experience has shown, the life of e.g. a double diaphragm is not only twice that of a single diaphragm, but is a multiple.

Also the protective diaphragm provided in the sandwich diaphragm of the invention, which forms the third zone, consists of one or more single plies. In the region of the flexible diaphragm deformation zone the bead of the protective diaphragm is clearly developed more, so that in normal operation a load applied by the delivery pressure does not occur in this region. This means that in normal operation the protective diaphragm runs along at noload, so that its life clearly exceeds that of the working diaphragm.

In case of damage to or rupture of the working diaphragm, the protective diaphragm assumes the function thereof, i.e. it then performs the conveyance and sealing. Due to the identical main dimensions, the delivery output remains almost the same. The protective diaphragm can take over the delivery for a limited time until there is an opportune moment for the change of diaphragm.

The intermediate layer provided in the sandwich diaphragm in a preferred form of realization, which constitutes the second zone, fulfills two functions. One is that the channel provided in this intermediate layer, having for example the form of one or more radial slots, serves for diaphragm rupture signaling, since thereby, together with a bore in the clamping region of the working diaphragm and a corresponding bore in the diaphragm pump head, a connection is established from the interior of the diaphragm to the outside. The diaphragm rupture indication can be effected in various ways by means of appropriate sensors, which may be screwed directly into the thread of the diaphragm pump head or connected to a conduit. The indication may be optical, acoustic, or electrical. The other function of the intermediate layer is a supporting function for the working diaphragm. This is due to the fact that the intermediate layer is adapted in its form to the working diaphragm and mechanically abuts the latter directly in operation. It thus takes over a part of the load of the working or delivering diaphragm and thereby contributes to a longer life of the working diaphragm.

Figure 2:
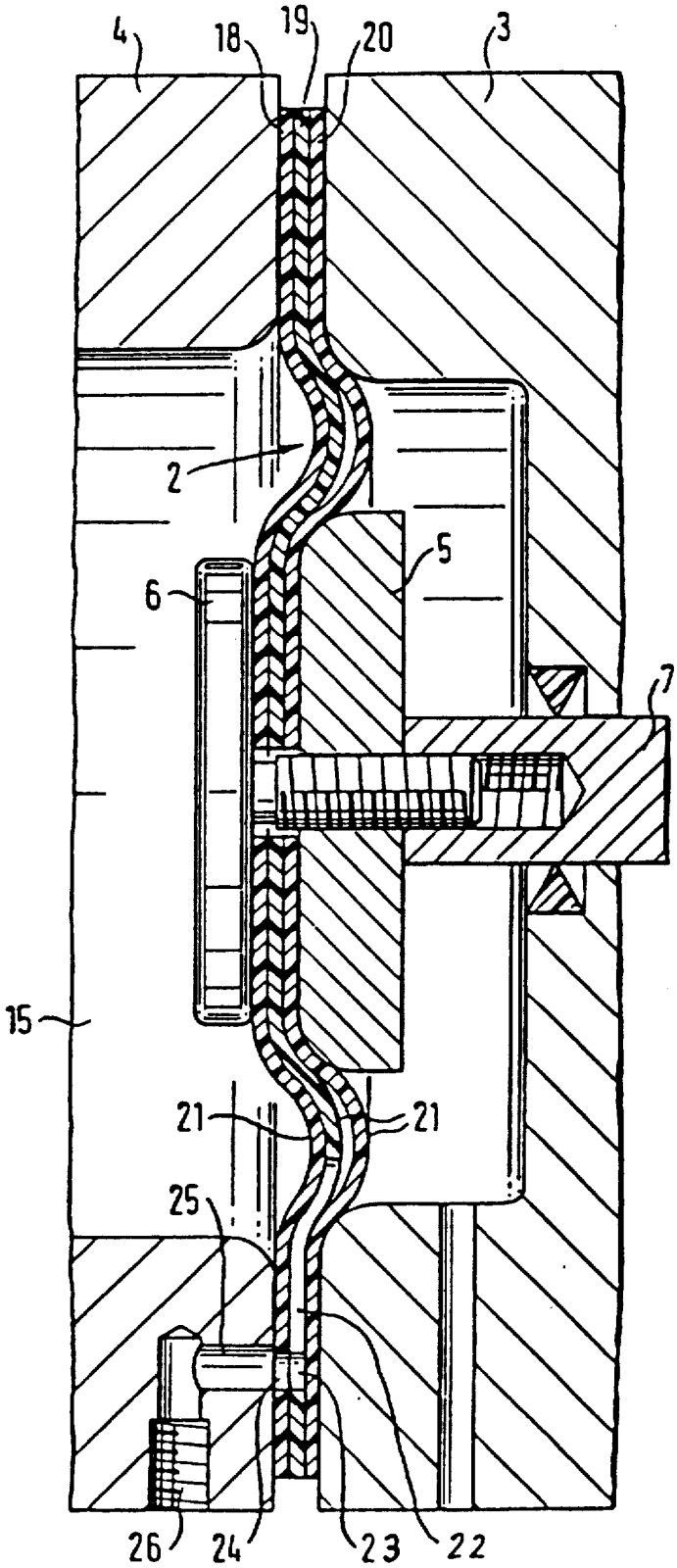
Figure 3A:
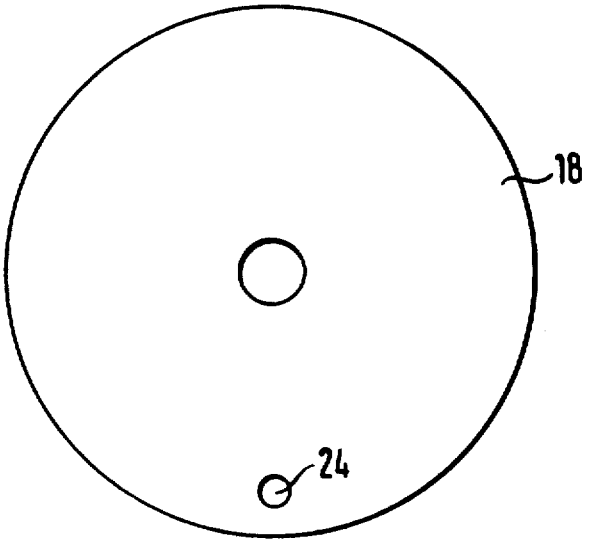
Figure 3B:
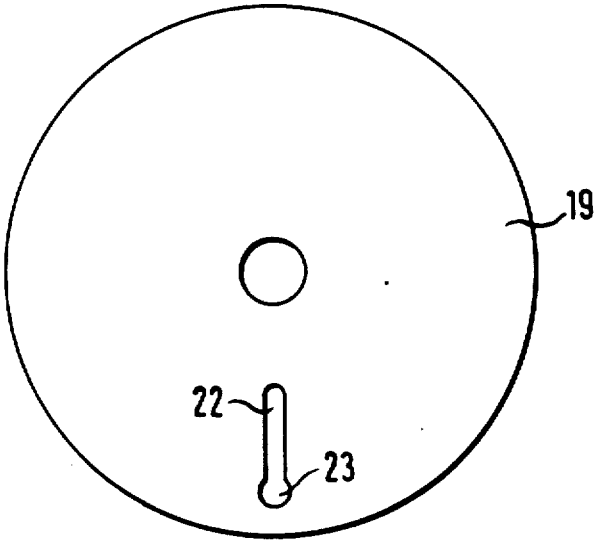
Figure 3C:
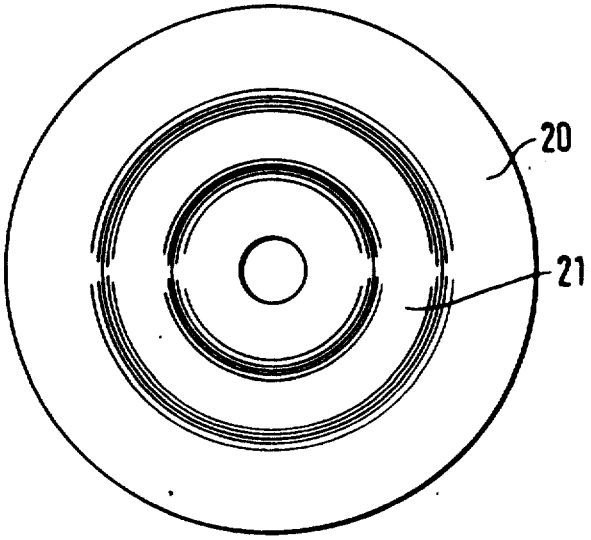
Figure 4:
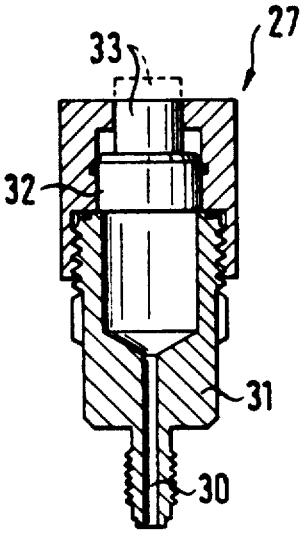
Figure 5:
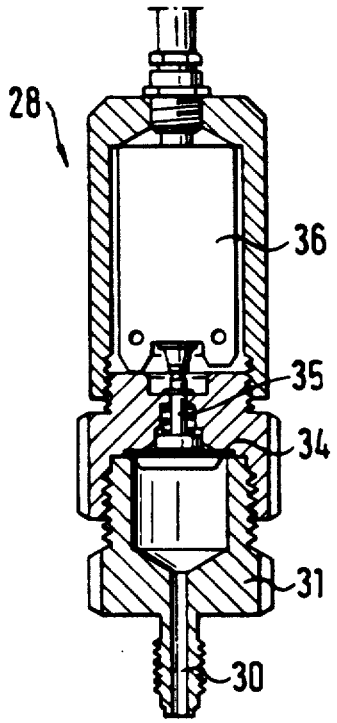
Figure 6:
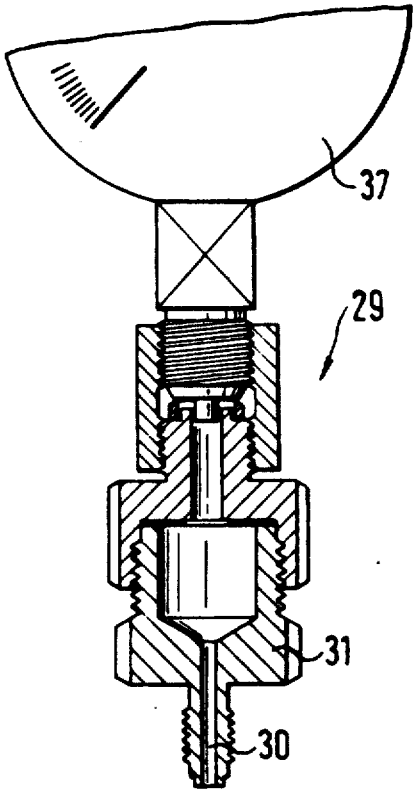
Figure 7:
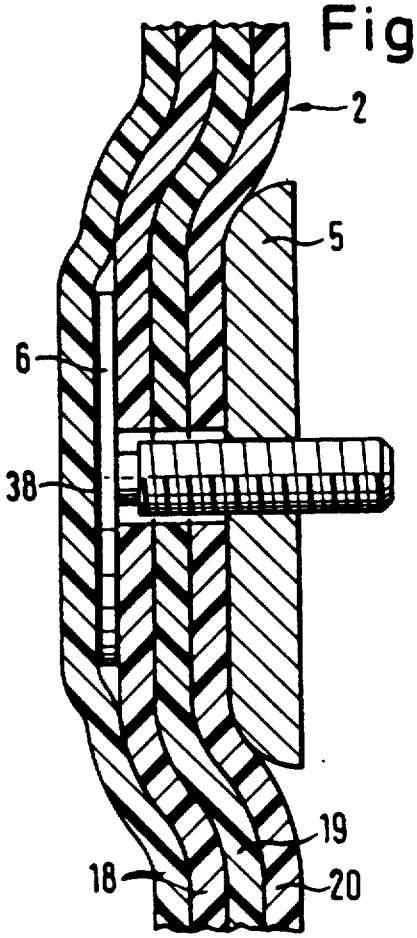
Figure 8:
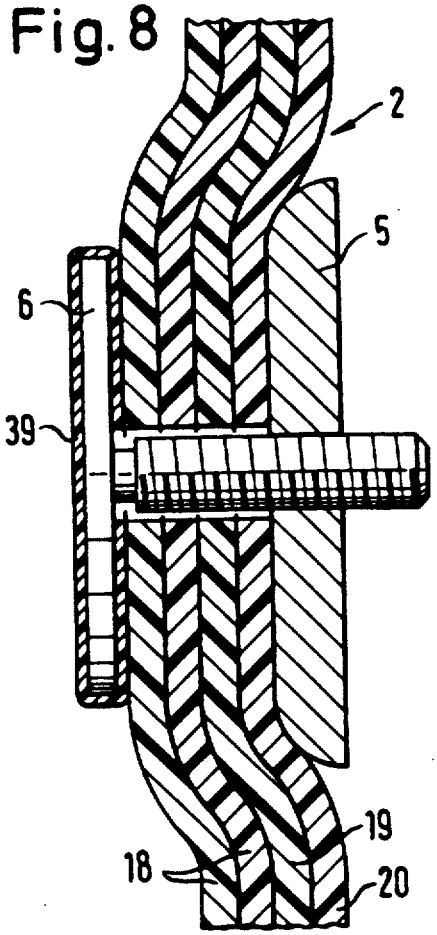

In the following the invention will be explained more specifically with reference to the drawing, in which:

FIG. 1 shows schematically, in longitudinal section, the diaphragm pump according to the invention equipped with the diaphragm rupture signaling;

FIG. 2, on a larger scale, in detail, the diaphragm design in the pump head;

FIGS. 3*a*, 3*b*, 3*c*, each in front view, the working diaphragm, the intermediate ply, and the protective diaphragm of the sandwich diaphragm;

FIG. 4, schematically in vertical section, a device for diaphragm rupture indication in the form of an optical sensor, FIG. 5, in the form of a diaphragm pressure switch and FIG. 6, in the form of a pressure gauge indication;

FIG. 7, in section, a modified form of realization of the central diaphragm clamping;

FIG. 8, another modified form of this central diaphragm clamping; and

Figure 9:
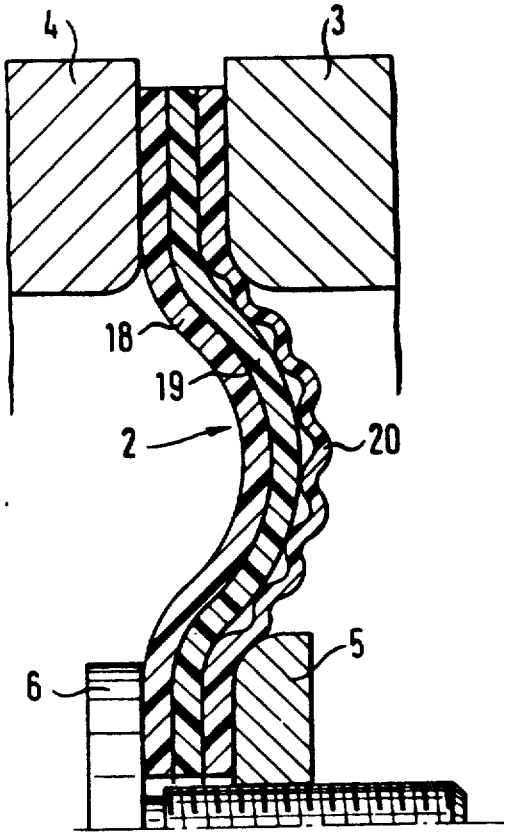

FIG. 9, a modified form of the protective diaphragm.

As can be seen from the drawing, in particular from FIGS. 1 and also 2, the illustrated diaphragm pump 1 has a mechanically linked or mechanically driven diaphragm 2. The latter is clamped at the edge between a pump body 3 and a pump cover 4 and is centrally firmly connected with a support plate 5 serving to drive the diaphragm. As is evident in particular from FIG. 2, the central clamping is here carried out so that in its central region the diaphragm 2 is arranged between the support plate 5 and a holding plate 6, which is screwed into a threaded bore in the support plate 5. The support plate 5 in turn is attached at the end of a push rod 7 movable to and fro, which is guided and supported under seal in the pump body 3. The drive motion of the push rod 7, occurring from right to left in FIG. 1, —and hence the pressure stroke of the diaphragm 2—is brought about mechanically by means of a drive motor 8 via a worm gear 9 and an eccentric shaft. On the other hand, the restoring motion of push rod 7, occurring from left to right in FIG. 1, —and hence the suction stroke of diaphragm 2—is achieved through a compression spring 10, braced between an inner housing-fixed shoulder 11 of pump body 3 and a shoulder 12 of push rod 7.

As can be seen from FIG. 1, a stroke adjusting device 13 in the interior of pump body 3, operable by hand from the outside through a handwheel 14, permits the setting of the respective stroke length of push rod 7.

The pump cover 4 forming the pump head defines, together with the diaphragm 2, a delivery chamber 15, into which the medium to be conveyed can enter in arrow direction via an inlet valve 16 and from which the conveyed medium can issue in arrow direction via an outlet valve 17.

As can be seen clearly from FIG. 2 as well as from FIG. 3, the diaphragm 2, clamped centrally between the support plate 5 and the holding plate 6 and driven mechanically by the support plate 5, is formed as a multi-layer sandwich diaphragm, which in the illustrated example of realization consists of three single layers or diaphragm plies, namely a working diaphragm 18 causing the delivery, a protective diaphragm 20 therebehind, and an intermediate ply 19 provided between them. The individual diaphragm plies 18, 19, 20 of this sandwich diagraph 2 are clamped jointly in their outer edge region between the pump body 3 and pump cover 4, and are also, as can be seen clearly from FIGS. 1 and 2, mechanically linked in their central region jointly between the support plate 5 and holding plate 6.

Although not specifically shown in FIG. 2, the working diaphragm 18 as well as the protective diaphragm 20 may consist not just of one single diaphragm ply, but of two or more discrete plies, forming in each case a multi-layer composite part in the form of a diaphragm packet 2, which forms an integral unit with the central screw union. The individual diaphragms 18, 19, 20 or respectively their discrete plies are made of plastic, preferably PTFE.

The protective diaphragm 20 is designed so that, with the working diaphragm 18 intact, it is stressed clearly less by the delivery pressure prevailing in the delivery chamber 15 than the working diaphragm 18. For this purpose, in the illustrated embodiment example all of the diaphragm plies 18, 19, 20 of the sandwich diaphragm 2 have an annular bead 21. The bead 21 of the protective diaphragm 20 is developed clearly more than that of the working diaphragm 18 and also of the intermediate ply 19. The concave side of all annular beads 21 points toward the delivery chamber 15.

As is clearly visible from FIGS. 2 and 3, for the purpose of diaphragm rupture indication a leakage slot 22 is provided in the intermediate ply 19. It extends radially and is about 1 mm wide in the illustrated example. In the clamping region of the sandwich diaphragm 2, this leakage slot 22 leads into a bore 23 in the intermediate ply 19. This bore communicates through a leakage bore 24 provided at a corresponding point in the working diaphragm 18 with a channel 25 of the pump cover 4 leading out of the pump cover 4. It is thereby ensured, in case of diaphragm rupture, in particular a rupture of the working diaphragm 18 facing the delivery chamber 15, that the medium penetrating into the interstice between working diaphragm 18 and protective diaphragm 20 is conducted to the outside via the leakage slot 22 and the associated bore 23 and then via the leakage bore 24 of the working diaphragm 18 and channel 25 of the pump cover 4. At its end brought to the outside, the channel 25 of pump cover 4 is designed as a connecting bore 26 into which can be screwed one of the sensors 27, 28, 29 per FIGS. 4, 5 or 6 serving for diaphragm rupture indication.

Sensor 27 per FIG. 4 is designed as an optical sensor, where in case of a diaphragm rupture a piston 32 is displaced by the fluid pressure propagating upwardly in a channel 30 of the sensor housing 31, namely from a lower—invisible—position into the position shown dashed in FIG. 4, in which an upper piston part 33, preferably made in a signal color, e.g. red, protrudes visibly outward from the sensor housing 31.

The sensor 28 per FIG. 5 is designed as a diaphragm switch, where in case of a diaphragm rupture the fluid pressure propagating upward via the channel 30 of the sensor housing 31 actuates a separating or isolating diaphragm 34. The latter in turn actuates a switch 36 via a pin 35.

Lastly, with the sensor 29 per FIG. 6 a possible diaphragm rupture is indicated optically, namely by means of a pressure gauge 37, the indicated pressure corresponding approximately to the delivery pressure prevailing in the delivery chamber 15. The pressure gauge 37 may be designed with a switching contact, so that also electric signaling is brought about.

In the modified form of realization of the central diaphragm clamping evident from FIG. 7, the advantage is that the support plate 5 has no contact with the conveyed liquid, so that it need not be made corrosion-proof. For this purpose, the first ply of the working diaphragm 18 which in the illustrated example consists of two single plies is connected on its side away from the delivery chamber 15 to the support plate 5, or rather to the holding plate 6 screwed into the support plate 5. Here the union is brought about by welding, a special plastic foil 38 being preferably inserted as welding aid.

As distinguished therefrom, in the further modified form per FIG. 8 the central clamping of the sandwich diaphragm 2 between support plate 5 and holding plate 6 is brought about in such a way that the individual diaphragm plies 18, 19, 20—just as in the form per FIGS. 1 and 2—are clamped between the support plate 5 and the holding plate 6 secured thereon, but the holding plate 6 is sheathed with a plastic layer 39.

In the modified form per FIG. 9, the protective diaphragm 20 is formed as a corrugated diaphragm in the region of the flexible diaphragm deformation zone. This results in greater elasticity and, connected therewith, lower stress.

With regard to features of the invention not specifically described above, reference is made expressly to the claims and to the drawing.

I claim:

1. A diaphragm pump with mechanically driven diaphragm and with a device for diaphragm rupture signaling, the diaphragm (2) being clamped at the edge between the pump body (3) and pump cover (4) and being firmly connected centrally with a support plate (5) that serves to drive the diaphragm, characterized in that the diaphragm is formed as a multi-layer sandwich diaphragm (2), the individual layers or diaphragm plies of which are jointly clamped in the edge region between the pump body (3) and pump cover (4), that the sandwich diaphragm (2) consists of a working diaphragm (18) with at least one diaphragm ply and a protective diaphragm (20) also with at least one diaphragm ply, that the protective diaphragm (20) is formed so that, with the working diaphragm (18) intact, it is clearly less stressed by the delivery pressure than the working diaphragm (18), and that the device for diaphragm rupture signaling includes at least one channel (22, 25) disposed between the diaphragms (18, 20) and brought to the outside for signaling a rupture of the working diaphragm (18).

2. Diaphragm pump according to claim 1, characterized in that the protective diaphragm (20) is designed so that in the flexible diaphragm deformation zone the working diaphragm (18) does not brace against the protective diaphragm (20).

3. Diaphragm pump according to claim 2, characterized in that in the flexible diaphragm deformation zone the protective diaphragm (20) is spaced from the working diaphragm (18).

4. Diaphragm pump according to claim 1, characterized in that the protective diaphragm (20) has an annular bead (21), the concave side of which points to the delivery chamber (15).

5. Diaphragm pump according to claim 1, characterized in that all diaphragm plies (18, 20) of the sandwich diaphragm (2) have an annular bead (21), the bead of the protective diaphragm (20) being developed more than that of the working diaphragm (18).

6. Diaphragm pump according to claim 1, characterized in that the protective diaphragm (20) is made of a material of greater elasticity than the working diaphragm (18).

7. Diaphragm pump according to claim 1, characterized in that in the region of the flexible diaphragm deformation zone the protective diaphragm is formed as a corrugated diaphragm (20).

8. Diaphragm pump according to claim 1, characterized in that the channel serving for diaphragm rupture signaling, having for example the form of one or more radial slots (22), is disposed in an intermediate ply (19) between the working diaphragm (18) and the protective diaphragm (20).

9. Diaphragm pump according to claim 1, characterized in that between the working diaphragm (18) and protective diaphragm (20), in the outer clamping region, a ring is provided which has the channel (22, 25) serving for diaphragm rupture signaling.

10. Diaphragm pump according to claim 1, characterized in that the central clamping of the sandwich diaphragm (2) is such that on its side away from the delivery chamber (15) the first ply of the working diaphragm (18) is connected, more particularly welded, to the support plate (5, 6).

11. Diaphragm pump according to claim 1, characterized in that the central clamping of the sandwich diaphragm (2) is such that all diaphragm plies (18, 19, 20) are clamped between the support plate (5) and a holding plate (6), the holding plate (6) being sheathed with a plastic layer (39).

* * * * *